US010125444B2

(12) United States Patent
Seo et al.

(10) Patent No.: US 10,125,444 B2
(45) Date of Patent: Nov. 13, 2018

(54) CONTROL METHOD FOR LAUNDRY TREATMENT APPARATUS

(71) Applicant: LG ELECTRONICS INC., Seoul (KR)

(72) Inventors: Inhyouk Seo, Seoul (KR); Youngho Kim, Seoul (KR); Sunku Kwon, Seoul (KR); Changsik Kim, Seoul (KR); Youngkee Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 51 days.

(21) Appl. No.: 15/065,965

(22) Filed: Mar. 10, 2016

(65) Prior Publication Data

US 2017/0073871 A1 Mar. 16, 2017

(30) Foreign Application Priority Data

Sep. 14, 2015 (KR) ..... 10-2015-0129959

(51) Int. Cl.
*D06F 35/00* (2006.01)
*D06F 39/08* (2006.01)
(Continued)

(52) U.S. Cl.
CPC ..... *D06F 35/006* (2013.01); *D06F 33/02* (2013.01); *D06F 39/088* (2013.01); *D06F 37/12* (2013.01);
(Continued)

(58) Field of Classification Search
CPC ..... G06F 35/006; G06F 39/088; G06F 33/02
(Continued)

(56) References Cited

U.S. PATENT DOCUMENTS 5,271,251 A * 12/1993 Kovich ..... D06F 23/04 68/171
5,887,456 A * 3/1999 Tanigawa ..... D06F 25/00 34/596

(Continued)

FOREIGN PATENT DOCUMENTS

| | | | |
|---|---|---|---|
| CN | 1300892 | A | 6/2001 |
| CN | 102140749 | A | 8/2011 |
| JP | 2014510607 | A | 5/2014 |

OTHER PUBLICATIONS

International Search Report and Written Opinion in International Application No. PCT/KR2016/001107, dated Jun. 14, 2016, 14 pages.

(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

A control method for a laundry treatment apparatus, where the laundry treatment apparatus includes a first reservoir for holding water and defining a first opening for introduction of laundry, a second reservoir placed inside the first reservoir, the second reservoir being rotatable about a rotation axis perpendicular to a bottom surface of the first reservoir and defining a second opening that is positioned under the first opening, a through-hole that is defined in the second reservoir, a spray unit for spraying water to an inside of the second reservoir, and a drain unit for draining water inside the first reservoir, includes rotating the second reservoir to thereby apply force on laundry received in the second reservoir, spraying water to the inside of the second reservoir via the spray unit, and discharging the sprayed water in the second reservoir to an outside of the first reservoir via the drain unit.

11 Claims, 8 Drawing Sheets

(51) Int. Cl.
*D06F 33/02* (2006.01)
*D06F 37/12* (2006.01)
*D06F 37/20* (2006.01)

(52) U.S. Cl.
CPC ..... *D06F 37/203* (2013.01); *D06F 39/083* (2013.01); *D06F 2204/065* (2013.01); *D06F 2204/082* (2013.01); *D06F 2204/084* (2013.01); *D06F 2204/086* (2013.01); *D06F 2222/00* (2013.01)

(58) Field of Classification Search
USPC ..... 68/12.19, 23.5; 8/158, 159
See application file for complete search history.

(56) References Cited

U.S. PATENT DOCUMENTS

| | | | | |
|---|---|---|---|---|
| 2002/0069466 | A1* | 6/2002 | Lyu | D06F 35/006 8/158 |
| 2010/0089100 | A1 | 4/2010 | Caetano et al. | |
| 2011/0061171 | A1 | 3/2011 | Kim et al. | |
| 2014/0033449 | A1* | 2/2014 | Im | D06F 39/08 8/137 |
| 2014/0083142 | A1 | 3/2014 | Chung et al. | |
| 2014/0208523 | A1 | 7/2014 | Kim et al. | |
| 2015/0007396 | A1 | 1/2015 | Lee et al. | |

OTHER PUBLICATIONS

Chinese Office Action in Chinese Application No. 201610074396.3, dated May 3, 2018, 15 pages.

* cited by examiner

CONTROL METHOD FOR LAUNDRY TREATMENT APPARATUS

This application claims the benefit of Korean Patent Application No. 10-2015-0129959, filed on Sep. 14, 2015, which is hereby incorporated by reference as if fully set forth herein.

FIELD

The present disclosure relates to a control method for a laundry treatment apparatus.

BACKGROUND

A laundry treatment apparatus can include a cabinet defining the external appearance of the apparatus, a first reservoir placed inside the cabinet and configured to store water therein, and a second reservoir rotatably placed inside the first reservoir and configured to receive laundry therein.

The laundry treatment apparatus having the above-described configuration is adapted to wash laundry using, for example, the emulsification of detergent and water streams produced by rotation of the second reservoir. In some cases, impurities may adhere to the inside of the first reservoir and the outer circumferential surface of the second reservoir after the long-term use of the laundry treatment apparatus.

SUMMARY

According to one aspect, a control method for a laundry treatment apparatus—where the laundry treatment apparatus includes a first reservoir configured to hold water and defining a first opening for introduction of laundry, a second reservoir placed inside the first reservoir and configured to receive laundry, the second reservoir being configured to rotate about a rotation axis perpendicular to a bottom surface of the first reservoir and defining a second opening that is positioned under the first opening, a through-hole that is defined in the second reservoir, a spray unit configured to spray water to an inside of the second reservoir, and a drain unit configured to drain water inside the first reservoir—includes rotating the second reservoir to thereby apply force on laundry received in the second reservoir, spraying water to the inside of the second reservoir via the spray unit, and discharging the sprayed water in the second reservoir to an outside of the first reservoir via the drain unit.

Implementations according to this aspect may include one or more of the following features. For example, the control method may further include draining the water in the first reservoir to the outside of the first reservoir via the drain unit, where the rotating, the spraying, and the discharging steps may be initiated after completion of the draining step. The rotating step and the spraying step may be implemented to at least partially overlap with each other during an overlapping period. The rotating, the spraying, and the discharging steps may be implemented to at least partially overlap with one another during an overlapping period. Additionally, in the spraying step, the spray unit may spray water that is supplied from a water source to a circumferential surface of the second reservoir. Also, in the spraying step, the spray unit may spray water that is supplied from a water source to a circumferential surface of the second reservoir and a bottom surface of the second reservoir. Further, in the spraying step, the spray unit may spray water to cover a region ranging from a first point to a second point, the first point being located between a corner, at which the circumferential surface of the second reservoir and the bottom surface of the second reservoir meet each other, and a center of rotation of the second reservoir, and the second point being located between the corner and the second opening.

In some cases, the spraying step may include a first operation of spraying water and a second operation of stopping the spraying of water. The first operation may have an implementation time that is longer than an implementation time of the second operation. The spraying step may be performed as a sequence where the first operation is followed by the second operation, or where the first operation is followed by the second operation and then followed by the first operation. Additionally, the rotating step may include increasing the number of revolutions per minute of the second reservoir to a predetermined reference number of revolutions per minute, and maintaining the number of revolutions per minute of the second reservoir at the reference number of revolutions per minute, where the spraying and the discharging steps may be performed during the step of increasing the number of revolutions per minute of the second reservoir. The providing step may include primarily increasing the number of revolutions per minute of the second reservoir to a predetermined first number of revolutions per minute, maintaining the number of revolutions per minute of the second reservoir at the first number of revolutions per minute, and secondarily increasing the number of revolutions per minute of the second reservoir to a predetermined reference number of revolutions per minute, which is set to be higher than the first number of revolutions per minute. The spraying and the discharging steps may be performed during the step of maintaining the number of revolutions per minute of the second reservoir at the first number of revolutions per minute. The control method may further include measuring a magnitude of vibration generated at the second reservoir during rotation of the second reservoir, where the measuring step may be performed while the second reservoir is rotated at the first number of revolutions per minute and the step of secondarily increasing the number of revolutions per minute of the second reservoir may be initiated based on the vibration measured in the measuring being a predetermined reference value or less.

In some implementations, the control method may further include supplying water to the first reservoir via a water supply unit connected to a water source, rotating the second reservoir so as to cause friction between the water and the laundry in the second reservoir, and draining the water inside the first reservoir to the outside of the first reservoir via the drain unit after completion of the rotating, wherein the providing, the spraying, and the discharging steps may be initiated after completion of the draining. The rotating step may include rotating the second reservoir such that the water inside the first reservoir is raised to a height of the second opening by centrifugal force. The rotating step may include controlling the number of revolutions per minute of the second reservoir so as to restrict the water from entering the second reservoir through the second opening. In some cases, the rotating step may include performing a primary rotation of the second reservoir, performing an intermediate draining of draining the water in the first reservoir, performing a secondary rotation of the second reservoir, performing an intermediate spraying of spraying water to the inside of the second reservoir via the spray unit while the secondary rotation step is being performed, and performing an intermediate discharging of discharging the water sprayed during the intermediate spraying to an outside of the first reservoir via the drain unit while the secondary rotation step is being performed. The number of revolutions per minute of the second reservoir in the secondary rotation step may be set to be higher than the number of revolutions per minute of the second reservoir set in the primary rotation step, and may be set to be lower than the number of revolutions per minute of the second reservoir set in the rotating step.

According to another aspect, a control method for a laundry treatment apparatus—where the laundry treatment apparatus includes a first reservoir configured to hold water and defining a first opening for introduction of laundry, a second reservoir placed inside the first reservoir and configured to receive laundry, the second reservoir being configured to rotate about a rotation axis perpendicular to a bottom surface of the first reservoir and defining a second opening that is positioned under the first opening, a through-hole that is defined in the second reservoir, a spray unit configured to spray water to an inside of the second reservoir, and a drain unit configured to drain water inside the first reservoir—includes supplying water to the first reservoir via a water supply unit connected to a water source, performing a primary rotation of the second reservoir, draining the water stored in the first reservoir, performing a secondary rotation the second reservoir so as to apply force on the laundry inside the second reservoir, spraying water to the inside of the second reservoir via the spray unit, discharging the water supplied to the second reservoir in the spraying to an outside of the first reservoir via the drain unit, and performing a tertiary rotation of the second reservoir so as to apply force on the laundry inside the second reservoir. The number of revolutions per minute of the second reservoir in the secondary rotation step is set to be lower than the number of revolutions per minute of the second reservoir in the tertiary rotation step, and is set to be higher than the number of revolutions per minute of the second reservoir set in the primary rotation step.

DETAILED DESCRIPTION

Figure 1:
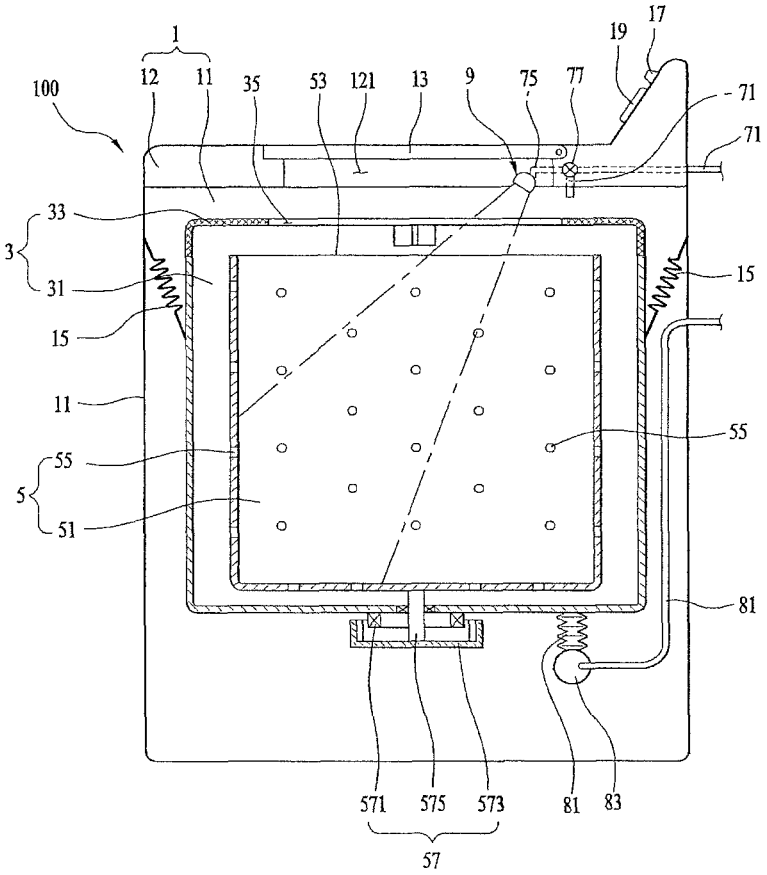
FIG. 1 is a partial cross-sectional view illustrating an exemplary laundry treatment apparatus.

FIG. 1 shows an exemplary laundry treatment apparatus 100 according to one implementation. The laundry treatment apparatus 100 according to the present disclosure may include a cabinet 1, a first reservoir 3 which is placed inside the cabinet 1 and configured to store water therein, and a second reservoir 5 which is rotatably placed inside the first reservoir 3 and configured to receive laundry therein.

The cabinet 1 may include a cabinet body 11 which provides a space in which the first reservoir 3 is received, and a cabinet cover 12 provided at the top of the cabinet body 11.

The cabinet cover 12 has a cabinet opening 121, through which laundry may be introduced into or removed from the cabinet 1. The cabinet opening 121 may be opened or closed by a door 13 provided at the cabinet cover 12.

In addition, the cabinet cover 12 may be further provided with an input unit 17 which allows a user to input a control command to the laundry treatment apparatus 100, and a display unit 19 which allows the user to check the control command input via the input unit 17 or may indicate, for example, the implementation of the control command input by the user.

The first reservoir 3 may include a first body 31 which provides a space in which water is stored. The first body 31 may be secured to the cabinet body 11 using a support unit 15. The support unit 15 may be configured to alleviate vibration when the first body 31 vibrates.

The first body 31 may take the form of a cylinder having an open top, and a cover 33 may be provided at the top of the first body 31. The cover 33 has a first opening 35 which can fluidically communicate with the cabinet opening 121.

The second reservoir 5 may include a second body 51 which is placed inside the first reservoir 3 and provides a space in which laundry is received. The second body 51 may take the form of an empty cylinder. The second body 51 may fluidically communicate with the first opening 35 and the cabinet opening 121 via a second opening 53.

The second body 51 may include through-holes 55 that are defined in at least one of the circumferential surface or the bottom surface thereof. As such, the through-holes 55 may allow water inside the second body 51 to move to the first body 31 therethrough, and may allow water supplied to the first body 31 to be supplied into the second body 51 therethrough.

The second body 51 described above may be adapted to be rotated by a drive unit 57. The drive unit 57 may include a stator 571 secured to the bottom surface of the first body 31 so as to be located outside the first body 31, a rotor 573 configured to be rotated by a rotational magnetic field provided by the stator 571, and a rotating shaft 575 penetrating the first body 31 to connect the bottom surface of the second body 51 and the rotor 573 to each other.

FIG. 1 illustrates, as an example, the case where the rotating shaft 575 is perpendicular to the bottom surface of the first body 31. In this case, the second opening 53 may be formed in the top of the second body 51, so as to be located under the first opening 35.

The laundry treatment apparatus 100 having the above-described configuration may be adapted to supply water to the first reservoir 3 using a water supply unit and to discharge the water inside the first reservoir 3 to the outside of the cabinet 1 using a drain unit.

The water supply unit may include a first supply pipe 71 connected to a water source to supply water to the first body 31, and a value 77 to open or close the first supply pipe 71. The drain unit may include a drain pipe 81 to guide the water inside the first body 31 to the outside of the cabinet 1, and a pump 83 to move the water inside the first body 31 to the drain pipe 81.

In addition, the laundry treatment apparatus 100 may further include a spray unit 9 which sprays water, supplied from the water source, to the inside of the second body 51. As exemplarily illustrated in FIG. 2, the spray unit 9 may include a connection pipe 93 secured to the cabinet cover 12 and a nozzle 91 configured to spray water supplied from the connection pipe 93 to the inside of the second body 51.

The connection pipe 93 may directly receive water from the water source, or may receive water through a second supply pipe 75 that diverges from the first supply pipe 71. In the latter case, the valve 77 may be located at the point at which the first supply pipe 71 and the second supply pipe 75 diverge so as to control the opening or closing of the first supply pipe 71 and the second supply pipe 75.

The nozzle 91 may be provided at the edge of the cabinet opening 121 at a position spaced apart, by a prescribed distance, from a virtual line L1 which passes through the rotating shaft 575 of the second body 51 and may be perpendicular to the rear surface of the cabinet 1 (or the front surface of the cabinet 1).

Figure 2:
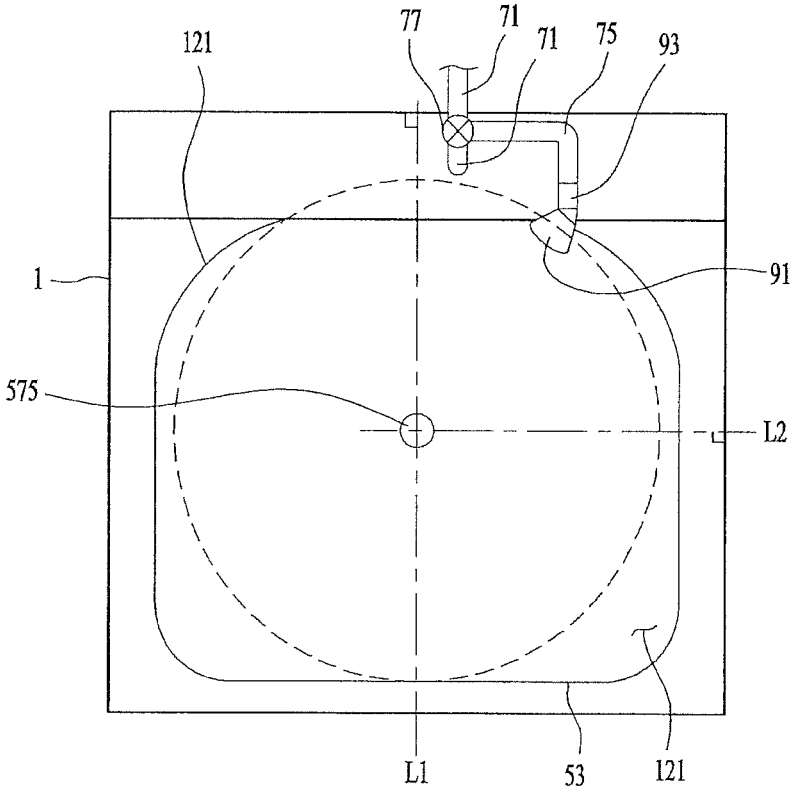
FIG. 2 is a schematic view illustrating an exemplary spray unit.

The nozzle 91 may be located at any of the front side and the rear side of a virtual line L2 which passes through the rotating shaft 575 and may be perpendicular to the side surface of the cabinet 1. FIG. 2 illustrates the exemplary case where the nozzle 91 is located at the rear side of the virtual line L2. In this case, the length of the second supply pipe 75 may be minimized, which may minimize loss in the pressure of water ejected from the nozzle 91.

In some cases, the nozzle 91 may be provided to spray water, supplied from the water source, only to the circumferential surface C1 of the second body 51, and may be provided to spray water to the corner at which the circumferential surface (C1, see FIG. 5) and the bottom surface C2 of the second body 51 meet each other.

In the case where the nozzle 91 is provided to spray water to the corner of the second body 51, the water spray range of the nozzle 91 may be set to a region from a first point (P1, see FIG. 5), which is located between the corner and the rotating shaft 575 of the second body 51, to a second point (P2, see FIG. 5) which is located between the corner and the second opening 53.

To realize the spray range of the nozzle 91 described above, the cross sectional area of the nozzle 91 may increase with increasing distance from the connection pipe 93.

Figure 3:
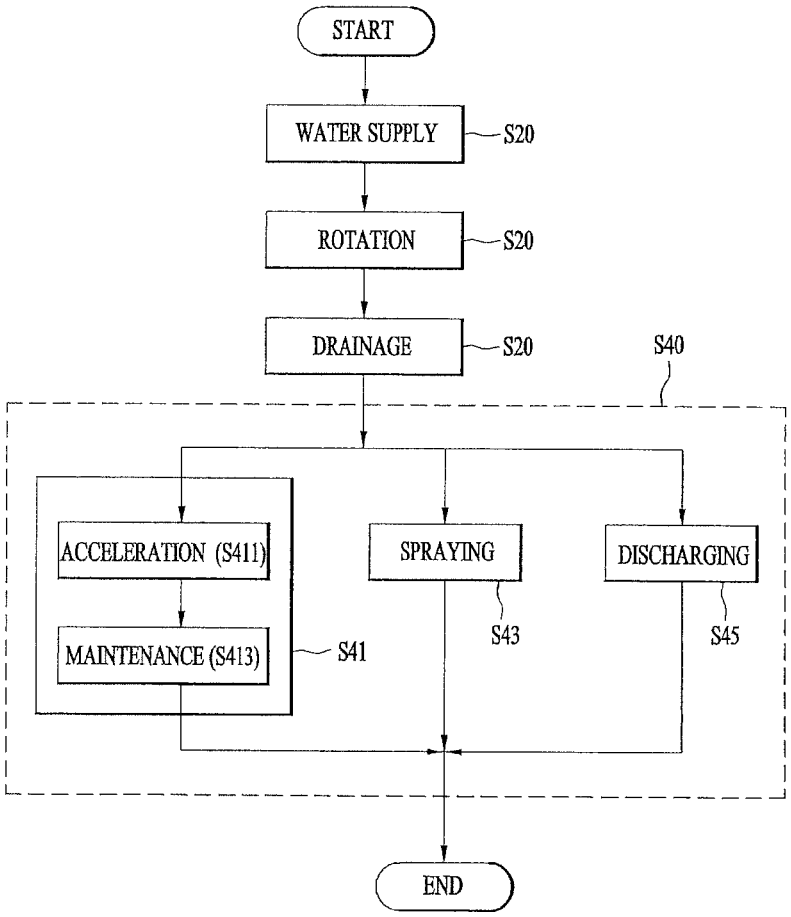
FIG. 3 is a flowchart illustrating an exemplary control method for a laundry treatment apparatus.

FIG. 3 shows an exemplary control method of a laundry treatment apparatus for the washing of the first reservoir 3 and the second reservoir 5.

The laundry treatment apparatus may be controlled such that the washing of the reservoirs 3 and 5 is implemented in response to the execution of a control command including an operation S20 of rotating the second reservoir 5 in the state in which water is stored in the first reservoir 3 (e.g., a washing cycle or a rinsing cycle), or an operation S41 of providing laundry stored in the second reservoir 5 with centrifugal force so as to separate water from the laundry (e.g., a dehydration cycle), even if the user does not input the reservoir washing course selection command to the input unit 17. However, the control method of the present disclosure may be initiated only when the user inputs a control command for the washing of the reservoirs 3 and 5 (e.g., a reservoir washing course selection command) to the input unit 17.

In the former case, the washing of the reservoirs 3 and 5 may be performed only while the rotating operation S20 is being performed, may be performed only while the centrifugal force providing operation S41 is being performed, or may be performed during each of the rotating operation S20 and the centrifugal force providing operation S41.

Hereinafter, the case where the washing of the reservoirs 3 and 5 is performed during each of the rotating operation S20 and the centrifugal force providing operation S41 will first be described with reference to FIG. 3, and then the other cases will be described.

When the user inputs, via the input unit 17, a single control command including the operation S20 of separating impurities from laundry and the operation S41 of separating water from laundry, the control method proceeds to an operation S10 of supplying water to the first body 31 via the water supply unit.

After completion of the water supply operation S10, the control method proceeds to the rotating operation S20 of rotating the second body 51 via the drive unit 57. The rotating operation S20 is an operation of rotating the second body 51 so as to cause friction between laundry and water stored inside the second body 51. The rotating operation S20 may be referred to as a washing cycle when it is performed in the state in which detergent and water have been supplied into the first body 31, or may be referred to as a rinsing cycle when it is performed in the state in which no detergent has been supplied into the first body 31. However, the rinsing cycle may be performed in the state in which rinsing detergent (e.g., a fabric conditioner) has been supplied.

Figure 4:
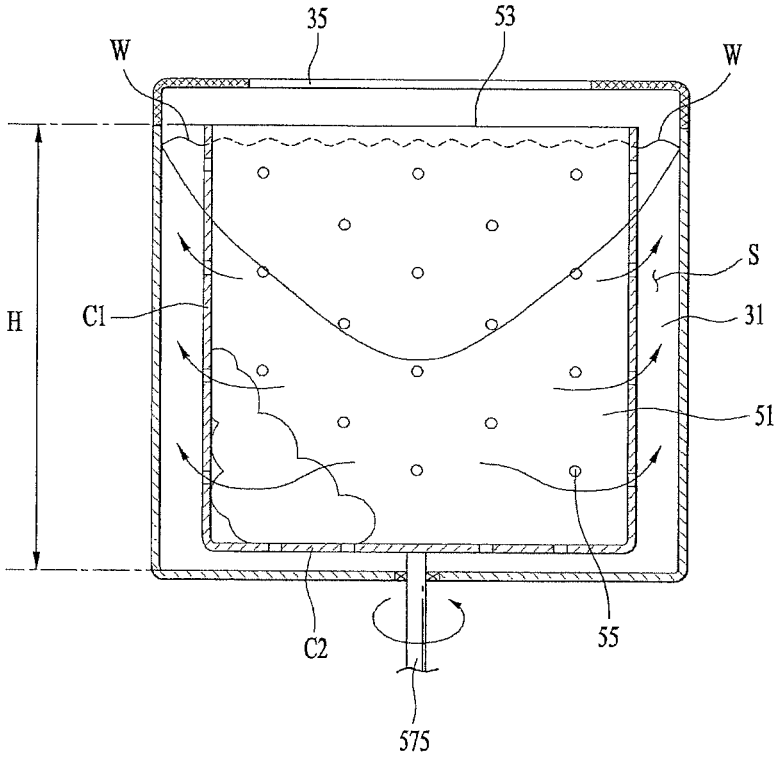
FIG. 4 is a schematic view illustrating an exemplary motion that washes reservoirs while washing or rinsing of laundry is being performed.

The laundry treatment apparatus may implement the motion illustrated in FIG. 4, in order to enable the washing of the reservoirs 3 and 5 while the rotating operation S20 is being performed. That is, while the rotating operation S20 is being performed, in the present disclosure, the number of revolutions per minute of the second body 51 is controlled to allow the level of water inside the first body 31 to be raised to a height H, at which the second opening 53 is located, by centrifugal force.

However, in the rotating operation S20, the drive unit 57 may control the number of revolutions per minute of the second body 51 so as to prevent the water inside the first body 31 from being introduced into the second body 51 through the second opening 53. In addition, in the rotating operation S20, the level W of water inside the first body 31 may remain lower than the height H of the second opening 53 for a predetermined time.

In the rotating operation S20 described above, even if the level of water inside the first body 31 is lower than the height of the second opening 53, the water inside the first body 31 may be supplied to the upper circumferential surface of the second body 51 and the upper circumferential surface of the first body 31 by centrifugal force. Accordingly, in the rotating operation S20, the water, supplied for the washing or rinsing of laundry, may be directed to impurities adhering to the upper portion of the first body 31 and the upper portion of the second body 51.

When impurities are adhered to the upper portion of the first body 31 and the upper portion of the second body 51, the impurities may be changed to the state of being easily separated from the respective bodies 31 and 51 while the rotating operation S20 is being performed. Meanwhile, in the rotating operation S20, since the water S present between the outer circumferential surface of the second body 51 and the inner circumferential surface of the first body 31 will be rotated along with the second body 51, the impurities remaining on the respective bodies 31 and 51 may be separated from the respective bodies 31 and 51 by water streams generated by the rotation of the second body 51.

As shown in FIG. 3, after completion of the rotating operation S20 described above, the control method proceeds to an operation S30 of draining the water inside the first body 31 to the outside of the first body 31.

The drainage operation S30 may be performed via the drain unit 81 and 83. Impurities separated from the laundry in the drainage operation S30 and impurities separated from the respective bodies 31 and 51 may be discharged, along with the water, out of the first body 31.

When the rotating operation S20 is a process that removes impurities from laundry using detergent and water (i.e. a washing cycle), the water supply operation, the rotating operation, and the drainage operation may be performed once more after completion of the drainage operation S30. The additionally performed water supply operation, rotating operation, and drainage operation may be referred to as a process whereby the detergent remaining on the laundry is removed (i.e. a rinsing cycle).

After completion of the drainage operation S30, the control may proceed to the centrifugal force providing operation S41 of separating water from laundry. The centrifugal force providing operation S41 is an operation of providing laundry with centrifugal force by rotating the second body 51, so as to separate water from the laundry.

While the centrifugal force providing operation S41 is being performed, the control method may proceed to an operation S43 of spraying water to the inside of the second body 51 through the nozzle 91. As exemplarily illustrated in FIG. 5, when water is sprayed to the inside of the second body 51 while the second body 51 is rotated, the water sprayed to the inside of the second body 51 may be discharged to the first body 31 through the through-holes 55.

Since the water, which is sprayed to the inside of the second body 51 during the rotation of the second body 51, needs to pass through the laundry in order to move to the through-holes 55, the spraying operation S43, which is initiated while the centrifugal force providing operation S41 is being performed, may serve to remove impurities or detergent remaining on the laundry.

In some cases, the water, which is discharged out of the second body 51 through the through-holes 55, may collide with the inner circumferential surface of the first body 31. In the course thereof, impurities remaining on the inner circumferential surface of the first body 31 may be separated from the first body 31 by the water discharged through the through-holes 55. In addition, the water discharged from the through-holes 55 may collide with the first body 31 and, in turn, collide with the second body 51. Therefore, the water discharged from the through-holes 55 may be used to remove impurities remaining on the second body 51. Accordingly, the spraying operation S43, which is initiated while the centrifugal force providing operation S41 is being performed, serves to wash the first body 31 and the second body 51.

To realize the effects described above, the time period during which the centrifugal force providing operation S41 is performed and the time period during which the spraying operation S43 is performed may be set to have an overlapping period.

In addition, in the spraying operation S43, the nozzle 91 may spray water supplied from the water source only to the circumferential surface of the second body 51, or may spray water to each of the circumferential surface and the bottom surface of the second body 51.

When it is desired to intensively wash the circumferential surface of the first body 31 and the circumferential surface of the second body 51, the nozzle 91 may be provided to spray water to the circumferential surface of the second body 51.

Figure 5:
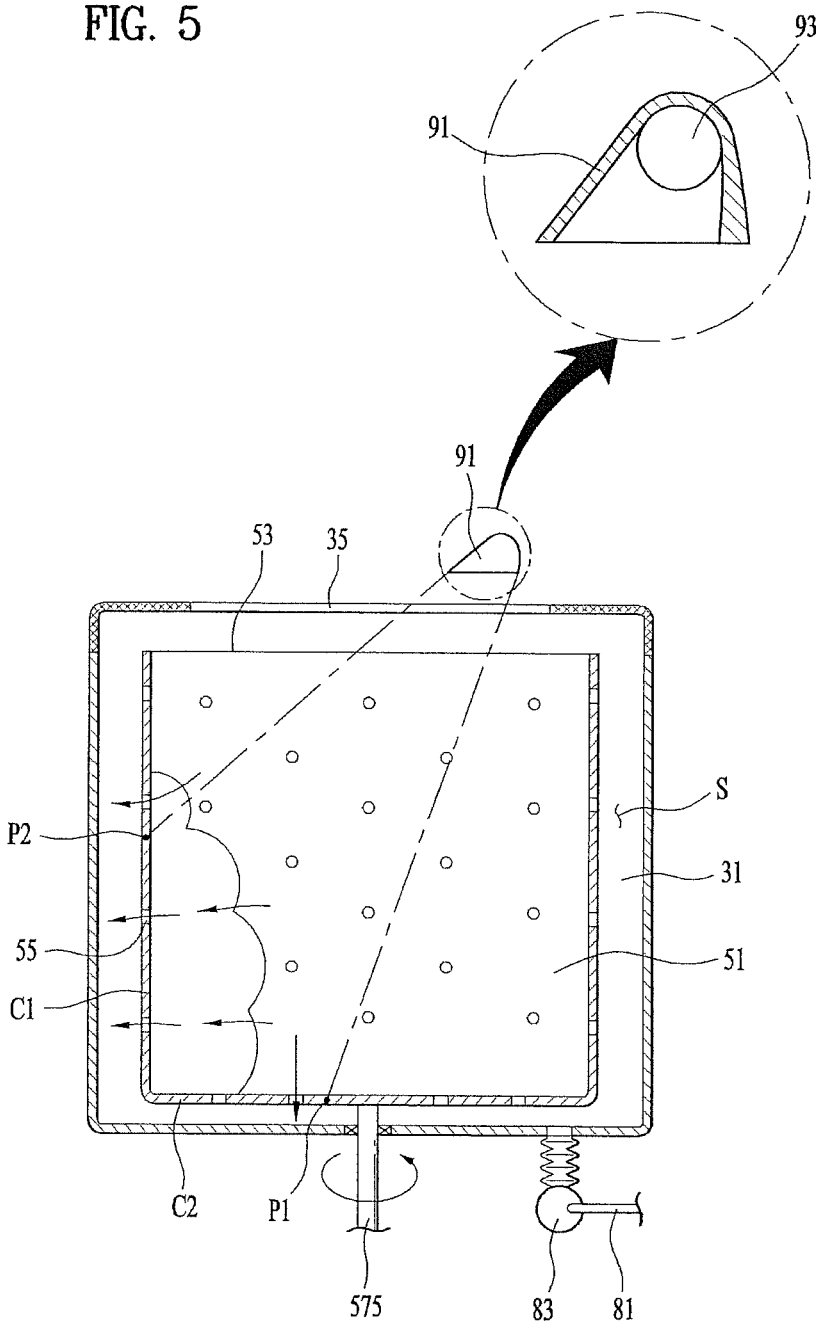
FIG. 5 is a schematic view illustrating an exemplary jet spray motion that washes reservoirs while dehydration of laundry is being performed.

However, in order to wash all of the circumferential surface of the first body 31, the circumferential surface C1 of the second body 51, the bottom surface of the first body 31, and the bottom surface C2 of the second body 51, the nozzle 91 may be provided to spray water to the circumferential surface C1 of the second body 51 and the bottom surface C2 of the second body 51 as exemplarily illustrated in FIG. 5.

In this case, the nozzle 91 may be provided to spray water to a range from the first point P1, which is located between the corner of the second body 51 and the center of rotation (the rotating shaft 575) of the second body 51, to the second point P2 which is located between the corner and the second opening 53 of the second body 51.

In the centrifugal force providing operation S41, the laundry stored inside the second body 51 will remain densely gathered near the point (corner) at which the circumferential surface C1 and the bottom surface C2 of the second body 51 meet each other due to centrifugal force. Therefore, when the nozzle 91 sprays water to the space between the first point P1 and the second point P2, most of the water discharged from the nozzle 91 will pass through the laundry and then be discharged to the first body 31. Accordingly, the feature whereby the nozzle 91 sprays water to the space between the first point P1 and the second point P2 (i.e. sprays water toward the corner of the second body 51) serves to maximize the washing of each body 31 or 51 and the washing of the laundry stored in the second body 51.

In some cases, when the water discharged from the laundry in the centrifugal force providing operation S41 and the water sprayed to the second body 51 in the spraying operation S43 are not discharged out of the first body 31, the water inside the first body 31 may prevent the rotation of the second body 51, thus preventing the second body 51 from being rotated at high speed.

To prevent the above-described problem, the control method of the present disclosure may further include an operation (S45, see FIG. 3) of discharging the water inside the second body 51 to the outside of the first body 31 through the drain unit 81 and 83 while the centrifugal force providing operation S41 and the spraying operation S43 are being performed. That is, the time period during which the centrifugal force providing operation S41 is performed, the time period during which the spraying operation S43 is performed, and the time period during which the discharge operation S45 is performed may be set to have an overlapping period.

Despite the inclusion of the discharge operation S45, when a great amount of laundry is stored in the second body 51 or when the laundry contains a great amount of water, water exceeding a desired level may remain inside the first body 31 while the centrifugal force providing operation S41 and the spraying operation S43 are being performed.

To prevent the problem described above, the spraying operation S43 may include spraying water through the nozzle 91 (first operation) and temporarily stopping the spraying of water (second operation). That is, the spraying operation S43 may be performed in the sequence of the first operation and the second operation, or may be performed by repeating the sequence of the first operation and the second operation. However, in order to achieve the desired effects of the spraying operation S43, the implementation time of the first operation may be set to be longer than the implementation time of the second operation.

In addition, the spraying operation S43 may be performed in the sequence of the first operation, the second operation, and the first operation, or may be performed by repeating the sequence of the first operation, the second operation, and the first operation.

As described above, since the centrifugal force providing operation S41 is an operation of providing laundry with centrifugal force so as to separate water from the laundry, the second body 51 may be rotated at a predetermined reference number of revolutions per minute for a given time or more, in order to achieve the desired effects. Therefore, a controller generally controls the number of revolutions per minute of the second body 51 as exemplarily illustrated in FIG. 6A in the centrifugal force providing operation S41.

Figure 6A:
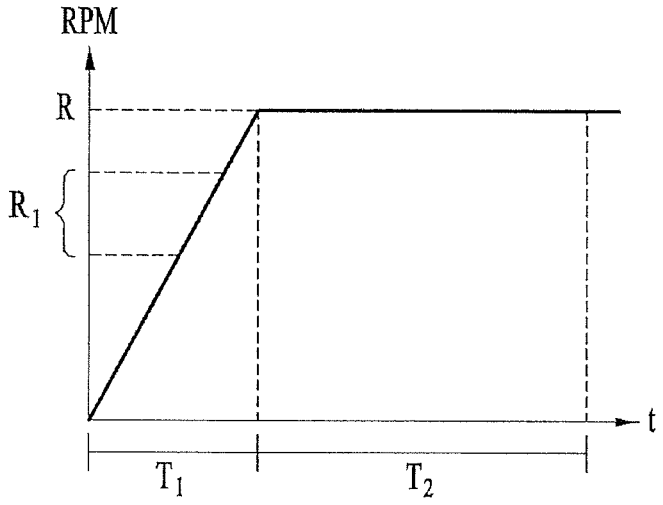
FIGS. 6A and 6B are example plots illustrating variations in the number of the revolutions per minute (RPM) of a second reservoir in a centrifugal force providing operation.

That is, as exemplarily illustrated in FIG. 6A, the centrifugal force providing operation S41 generally includes an acceleration operation T1 of increasing the number of revolutions per minute of the second body 51 to a reference number of revolutions per minute R and a maintenance operation T2 of maintaining the number of revolutions per minute of the second body 51 at the reference number of revolutions per minute R.

In the case where the reference number of revolutions per minute R is the highest number of revolutions per minute of the second body 51 preset for the implementation of the centrifugal force providing operation S41, the spraying operation S43 may be performed during the acceleration period T1.

When water is sprayed to the second body 51 while the second body 51 is rotated at the reference number of revolutions per minute R, there is a likelihood that the water sprayed from the nozzle 91 may remain inside the second body 51, rather than moving to the first body 31 through the through-holes 55, due to the high number of revolutions per minute of the second body 51.

In some cases, when external force is input to the second body 51 while the second body 51 is accelerated to the reference number of revolutions per minute R, there may occur the problem whereby the load on the drive unit 57, which rotates the second body 51, increases, or the problem whereby the operation of the drive unit 57 becomes unstable. Accordingly, in the case where the spraying operation S43 is performed during the acceleration operation T1, it may be necessary to appropriately select the number of revolutions per minute of the second body 51 at the beginning of the spraying operation S43 in consideration of variables that determine the magnitude of centrifugal force (i.e., the diameter of the second body 51 and the amount of laundry stored in the second body 51).

That is, the spraying operation S43 may be provided to spray water to the second body 51 at a first number of revolutions per minute, which is set to be lower than the reference number of revolutions per minute R. The first number of revolutions per minute R1 may be set to a range of revolutions per minute having a lowest value (lowest number of revolutions per minute) at which the spraying operation S43 is initiated and a highest value (highest number of revolutions per minute) at which the spraying operation S43 ends.

Figure 6B:
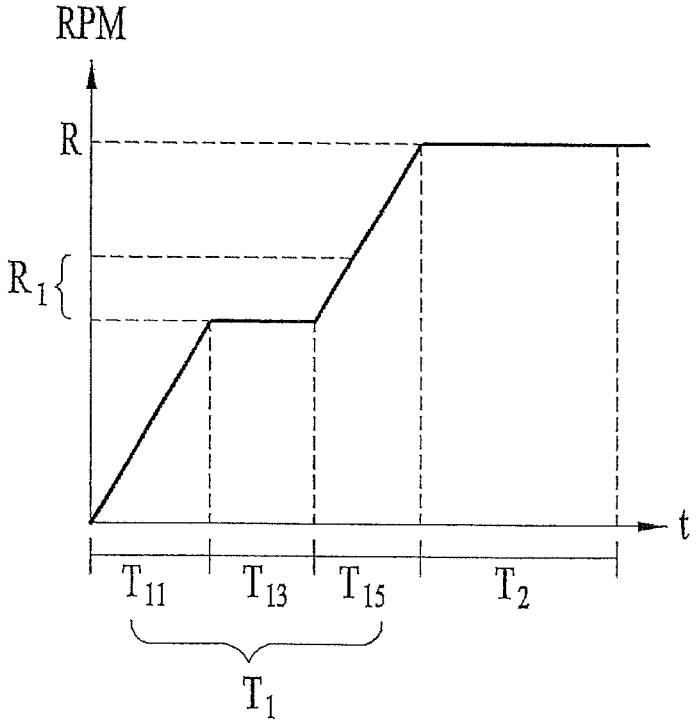

FIG. 6B illustrates a case in which the acceleration period T1 includes a period during which the number of revolutions per minute of the second body 51 is maintained at the first number of revolutions per minute R1, such that the spraying operation S43 is performed during the maintenance period so as to minimize the problem whereby the load on the drive unit 57 is increased due to the spraying operation S43 or the problem whereby the operation of the drive unit 57 becomes unstable.

That is, the centrifugal force providing operation S41 of FIG. 6B includes the acceleration operation T1 and the maintenance operation T2 in the same manner as the case in FIG. 6A. However, the acceleration operation T1 includes a first acceleration operation T11 of increasing the number of revolutions per minute of the second body 51 to a predetermined first number of revolutions per minute R1, an operation T13 of maintaining the number of revolutions per minute of the second body 51 at the first number of revolutions per minute R1, and a second acceleration operation T15 of increasing the number of revolutions per minute of the second body 51 to the reference number of revolutions per minute R, and the spraying operation S43 is performed while the number of revolutions per minute of the second body 51 is maintained at the first number of revolutions per minute R1 (T13).

In this case, when the operation T13 of maintaining the number of revolutions per minute of the second body 51 at the first number of revolutions per minute is performed, the control method of may further include a vibration sensing operation along with the spraying operation S43 and the discharge operation S45.

When laundry is not distributed throughout the interior of the second body 51, but is gathered in a certain region in the second body 51, vibrations are generated during the rotation of the second body 51. When the vibration generated at the second body 51 exceeds a given level, the second body 51 may collide with the first body 31 during the rotation thereof. That is, when laundry is gathered only in a certain region inside the second body 51, the second body 51 has difficulty in rotating at high speed.

The vibration sensing operation is an operation of predicting the magnitude of vibration that will be generated when the second body 51 is rotated at the reference number of revolutions per minute R by measuring the magnitude of vibration of the second body 51, which is being rotated at a lower number of revolutions per minute than the reference number of revolutions per minute R.

The vibration sensing operation may be performed by comparing the magnitude of vibration generated at the first body 31 during the rotation of the second body 51 with a predetermined reference value, or may be performed by comparing the magnitude of vibration generated at the second body 51 during the rotation of the second body 51 with the reference value.

The measurement of the magnitude of vibration generated at the second body 51 may be implemented using various methods. For example, the vibration of the second body 51 may be directly measured using, for example, a vibration sensor, or the magnitude of vibration of the second body 51 may be estimated by monitoring the number of revolutions per minute of the rotor 573.

In the case when the vibration sensing operation is provided, the control method may proceed to the second acceleration operation T15 of increasing the number of revolutions per minute of the second body 51 from the first number of revolutions per minute R1 to the reference number of revolutions per minute R when the vibration measured in the vibration sensing operation is the predetermined reference value or less.

As mentioned above, the above-described washing of the reservoirs 3 and 5 may be performed only while the rotating operation S20 is being performed, or may be performed only while the centrifugal force providing operation S41 is being performed.

In the case where the washing of the reservoirs 3 and 5 is performed only while the rotating operation S20 is being performed, the control method includes the water supply operation S10, the rotating operation S20, and the drainage operation S30, and the number of revolutions per minute of the second body 51 is controlled to maintain the level of water inside the first body 51 in the manner illustrated in FIG. 4 while the rotating operation S20 is performed.

In some cases, in the case where it is desired to implement a control method S40 of washing the reservoirs 3 and 5 only during dehydration (called a jet spray motion), the control method may include the centrifugal force providing operation S41 of providing the laundry stored inside the second body 51 with centrifugal force by rotating the second body 51, the spraying operation (S43, FIG. 5) of spraying water to the inside of the second body 51 through the nozzle 91, and the discharge operation S45 of discharging the water, supplied to the second body 51 in the spraying operation S43, to the outside of the first body 31 through the drain unit 81 and 83.

When the laundry treatment apparatus that performs the control method of the present disclosure is a washing machine and water is stored in the first body 31 prior to initiating the centrifugal force providing operation S41, the control method may be implemented in the sequence of the centrifugal force providing operation, the spraying operation, and the discharge operation, after the drainage operation of draining water inside the first body 31 through the drain unit 81 and 83 has been performed. However, when the laundry treatment apparatus that performs the control method of the present disclosure is an apparatus that is only for the purpose of dehydration, the control method may include the centrifugal force providing operation, the spraying operation, and the discharge operation without the drainage operation described above.

As described above, since the washing of the reservoirs 3 and 5 is always possible while the laundry treatment apparatus is operated for the washing, rinsing, and dehydration of laundry, the control method may enable the sanitary management of the laundry treatment apparatus even if the user does not attempt to wash the reservoirs 3 and 5 by executing a separate course and even if the laundry treatment apparatus periodically executes a separate course for washing only the reservoirs 3 and 5.

Figure 7:
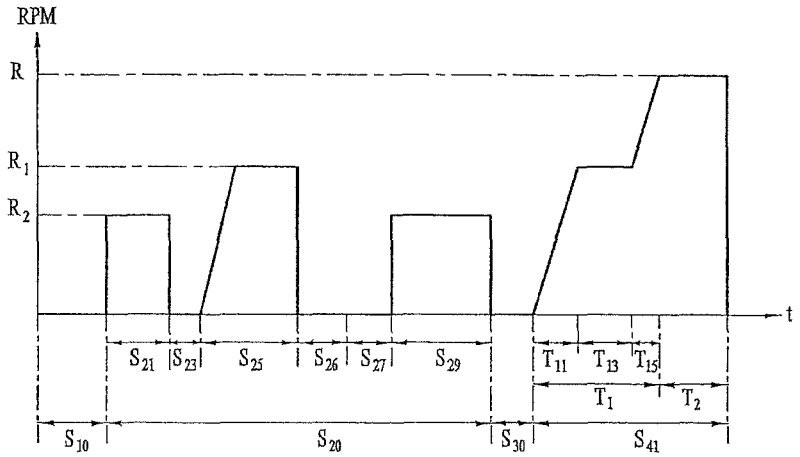
FIG. 7 is an example plot illustrating another implementation of the control method.

FIG. 7 shows another implementation of the laundry treatment apparatus. The control method according to the present implementation also includes the water supply operation S10, the rotating operation S20, the drainage operation S30, and the centrifugal force providing operation S41. However, the present implementation has the feature that the motion of FIG. 5 may be performed during the rotating operation S20.

To execute the present implementation, the rotating operation S20 may include a first rotating operation S21 of rotating the second body 51 at the second number of revolutions per minute R2 in the state in which water is stored in the first body 31, an intermediate drainage operation (first intermediate drainage operation) S23 of draining the water inside the first body 31 after completion of the first rotating operation S21, a second rotating operation S25 of rotating the second body 51 at the first number of revolutions per minute R1 which is set to be higher than the second number of revolutions per minute R2, an intermediate drainage operation (second intermediate drainage operation) S26 of draining the water inside the first body 31 after completion of the second rotating operation S25, an intermediate water supply operation S27 of resupplying water to the first body 31, and a third rotating operation S29 of rotating the second body 51 in the state in which water has been supplied to the first body 31.

In the control method according to the present implementation, the number of revolutions per minute of the second body 51 may be controlled such that the motion of FIG. 4 is performed during the first rotating operation S21. The description related to the motion of FIG. 4 has been given above in detail, and thus, a detailed description thereof will be omitted hereinafter.

In addition, the control method according to the present implementation may control the spray unit 9 and the drain unit 81 and 83 so as to perform, during the second rotating operation S25, an intermediate spraying operation (i.e. an operation of spraying water into the second body 51 via the spray unit 9) and an intermediate discharge operation (i.e. an operation of discharging the water inside the first body 31 while the spraying operation S43 is being performed).

The detailed control process of the intermediate spraying operation and the intermediate discharge operation may be identical to that of the spraying operation S43 and the discharge operation S45 described above, and thus a detailed description thereof will be omitted hereinafter. However, note that the first number of revolutions per minute R1 set in the second rotating operation S24 may be higher than the second number of revolutions per minute R2 set in the first rotating operation S21, and may be lower than the reference number of revolutions per minute R set in the centrifugal force providing operation S41, which is initiated after completion of the drainage operation S30.

In some cases, when the intermediate spraying operation and the intermediate discharge operation are executed while the second rotating operation S25 is being performed, the intermediate drainage operation S26 may be omitted.

The first rotating operation S21 may be referred to as a washing cycle of separating impurities from laundry when it is performed in the state in which detergent and water have been supplied into the first body 31, and the third rotating operation S29 may be referred to as a rinsing cycle of removing detergent or impurities remaining on laundry using the water supplied to the first body 31 via the intermediate water supply operation S27.

In this case, the second rotating operation S25, which is performed between the first rotating operation S21 and the third rotating operation S29, may serve to minimize the amount of water required in the third rotating operation S29, thereby reducing the implementation time of the third rotating operation S29, and may additionally serve to wash the reservoirs 3 and 5.

The control method proceeds to the drainage operation S30 of draining the water inside the first body 31 via the drain unit 81 and 83 after completion of the third rotating operation S29.

After completion of the drainage operation S30, the control method of the present disclosure may execute all of the centrifugal force providing operation S41, the spraying operation S43, and the discharge operation S45, or may execute only the centrifugal force providing operation S41 after completion of the drainage operation S30.

In the case where all of the centrifugal force providing operation S41, the spraying operation S43, and the discharge operation S45 are executed after completion of the drainage operation S30, the spraying operation S43 and the discharge operation S45 may be performed during the operation T13 of maintaining the number of revolutions per minute of the second body 51 at the first number of revolutions per minute R1.

Similar to the implementation of FIG. 3, in the present implementation, when the operation T13 of maintaining the number of revolutions per minute of the second body 51 at the first number of revolutions per minute R1 is performed, the control method may further include a vibration sensing operation along with the spraying operation S43 and the discharge operation S45.

When the vibration sensing operation is provided and the vibration measured in the vibration sensing operation is equal to or less than a predetermined reference value, in the present implementation, the number of revolutions per minute of the second body 51 may increase to the reference number of revolutions per minute R which is the final target number of revolutions per minute in the centrifugal force providing operation (T15 and T2).

As is apparent from the above description, the present disclosure may help realize the effect of providing and controlling a laundry treatment apparatus that enables the washing of a first reservoir in which water is stored and a second reservoir in which laundry is stored.

In addition, the present disclosure may help realize the effect of providing and controlling a laundry treatment apparatus that enables the washing of a first reservoir and a second reservoir while washing or rinsing of laundry is being performed.

In addition, the present disclosure may help realize the effect of providing and controlling a laundry treatment apparatus enables the washing of a first reservoir and a second reservoir while dehydration of laundry is being performed.

In addition, the present disclosure may help realize the effect of providing and controlling a laundry treatment apparatus that implements the washing of a first reservoir and a second reservoir via a jet spray motion which sprays water into the second reservoir while the second reservoir is rotated.

Although the example implementations have been illustrated and described above, it will be apparent to those skilled in the art that the implementations are provided to assist understanding of the present disclosure. The present disclosure is not limited to the above described particular implementations, and various modifications and variations can be made in the present disclosure without departing from the spirit or scope of the present disclosure.

What is claimed is:

1. A control method for a laundry treatment apparatus, the laundry treatment apparatus comprising a first reservoir being configured to hold water and defining a first opening provided at an upper surface of the first reservoir for introduction of laundry, a second reservoir placed inside the first reservoir and configured to receive laundry, the second reservoir defining a second opening under the first opening, a through-hole provided on the second reservoir, a spray unit configured to spray water to an inside of the second reservoir, and a drain unit configured to drain water inside the first reservoir, the control method comprising:

a first cycle and a second cycle, each cycle comprising at least one of washing the laundry or washing the first reservoir and the second reservoir, wherein the first cycle further comprises:

a supplying step of supplying water to the first reservoir via a water supply unit connected to a water source;

a rotating step of rotating the second reservoir for at least one of applying force to the laundry or raising the water to the upper surface of the first reservoir for washing the first reservoir and the second reservoir; and a draining step of draining at least one of the water inside the first reservoir or a foreign matter separated from the first reservoir and the second reservoir to the outside of the first reservoir via the drain unit after completion of the rotating, wherein the second cycle further comprises:

a force providing step of rotating the second reservoir to generate centrifugal force in the second reservoir;

a spraying step of spraying water to the inside of the second reservoir via the spray unit for at least one of rinsing the laundry or washing the first reservoir and the second reservoir; and a discharging step of discharging the sprayed water in the second reservoir to an outside of the first reservoir via the drain unit, and wherein the second cycle is initiated after completion of the draining step of the first cycle.

2. The control method according to claim 1, wherein the force providing step and the spraying step are implemented to at least partially overlap with each other during an overlapping period.

3. The control method according to claim 1, wherein in the spraying step, the spray unit sprays water that is supplied from a water source to a circumferential surface of the second reservoir.

4. The control method according to claim 1, wherein in the spraying step, the spray unit sprays water that is supplied from a water source to a circumferential surface of the second reservoir and a bottom surface of the second reservoir.

5. The control method according to claim 4, wherein in the spraying step, the spray unit sprays water to cover a region ranging from a first point to a second point, the first point being located between a corner, at which the circumferential surface of the second reservoir and the bottom surface of the second reservoir meet each other, and a center of rotation of the second reservoir, and the second point being located between the corner and the second opening.

6. The control method according to claim 1, wherein the force providing step includes increasing the number of revolutions per minute of the second reservoir to a predetermined reference number of revolutions per minute, and maintaining the number of revolutions per minute of the second reservoir at the reference number of revolutions per minute, wherein the spraying and the discharging steps are performed while increasing the number of revolutions per minute of the second reservoir.

7. The control method according to claim 1, wherein the force providing step includes:

a first acceleration step of increasing the number of revolutions per minute of the second reservoir to a predetermined first number of revolutions per minute, a maintaining step of maintaining the number of revolutions per minute of the second reservoir at the first number of revolutions per minute, and a second acceleration step of increasing the number of revolutions per minute of the second reservoir to a predetermined reference number of revolutions per minute, which is set to be higher than the first number of revolutions per minute, and wherein the spraying step and the discharging steps are performed during the maintaining step.

8. The control method according to claim 7, further comprising a measuring step of measuring a magnitude of vibration generated at the second reservoir during rotation of the second reservoir, wherein the measuring step is performed while the second reservoir is rotated at the first number of revolutions per minute, and wherein the second acceleration step is initiated based on the magnitude of vibration measured in the measuring step being a predetermined reference value or less.

9. The control method according to claim 1, wherein the rotating step includes:

a first rotating step of rotating the second reservoir;

an intermediate draining step of draining the water in the first reservoir;

a second rotating step of rotating the second reservoir;

an intermediate spraying step of spraying water to the inside of the second reservoir via the spray unit while the second rotating step is being performed; and an intermediate discharging step of discharging the water sprayed during the intermediate spraying to an outside of the first reservoir via the drain unit while the second rotating step is being performed.

10. The control method according to claim 9, wherein the number of revolutions per minute of the second reservoir in the second rotating step is set to be higher than the number of revolutions per minute of the second reservoir set in the first rotating step, and is set to be lower than the number of revolutions per minute of the second reservoir set in the force providing step.

11. The control method according to claim 10, wherein the number of revolutions per minute of the second reservoir in the second rotating step is set to be lower than the number of revolutions per minute of the second reservoir in the force providing step, and is set to be higher than the number of revolutions per minute of the second reservoir set in the first rotating step.

* * * * *